United States Patent [19]

Smutny

[11] 4,130,143

[45] Dec. 19, 1978

[54] BAND GUIDE ROLLER FOR BAND-GRIPPER LOOMS

[75] Inventor: Viktor Smutny, Wetzikon, Switzerland

[73] Assignee: Ruti Machinery Works Ltd, Ruti, Switzerland

[21] Appl. No.: 833,829

[22] Filed: Sep. 16, 1977

[30] Foreign Application Priority Data

Oct. 1, 1976 [CH] Switzerland ..... 12365/76

[51] Int. Cl.[2] ..... D03D 47/00

[52] U.S. Cl. ..... 139/449

[58] Field of Search ..... 139/429, 440, 443, 446, 139/449; 74/89, 22, 99, 108

[56] References Cited

U.S. PATENT DOCUMENTS

| | | | |
|---|---|---|---|
| 2,604,123 | 7/1952 | Budzyna et al. | 139/446 |
| 3,198,215 | 8/1965 | Tinkham | 139/449 |
| 3,999,580 | 12/1976 | Sparling | 139/449 |

FOREIGN PATENT DOCUMENTS

| | | | |
|---|---|---|---|
| 585293 | 2/1977 | Switzerland | 139/449 |
| 1148263 | 4/1969 | United Kingdom | 139/449 |

*Primary Examiner*—Henry S. Jaudon

*Attorney, Agent, or Firm*—Donald D. Denton

[57] ABSTRACT

A band-gripper loom having band guide rollers supported on a housing surrounding the band wheel to prevent the insertion band from lifting off the band wheel, with each band guide roller supported on the inner race of ball bearings.

9 Claims, 7 Drawing Figures

BAND GUIDE ROLLER FOR BAND-GRIPPER LOOMS

BACKGROUND OF THE INVENTION

The present invention relates to a band-gripper loom having a band wheel for driving an insertion band and having band guide rollers supported on a housing surrounding the band wheel to prevent the insertion band from lifting off from the band wheel.

In one known embodiment of such a band-gripper loom in which each band guide roller is supported on the outer race of a ball bearing, the ball bearings are damaged after only a relatively short period of operation so that they must be continuously replaced at short intervals.

The closest prior art known to applicant in connection with this application is German Patent No. 826,274.

SUMMARY OF THE INVENTION

The object of the present invention is to provide a band guide roller in which the said disadvantage of the known embodiment is avoided.

This objective is achieved, in accordance with the invention, by the fact that each band guide roller is supported on the inner race of a ball bearing.

With the band guide roller of the invention, the supporting thereof on the inner race of the ball bearing results in a reduction in the speed of rotation of the ball-bearing rollers by about 30 percent, which it is believed is the main reason that the life of the ball bearings is substantially increased and that practically no unexpected damage to the ball bearings occurs any longer when the band guide rollers of the invention are employed. Another advantage of the band guide roller of the invention is that the sealing rings, which are fastened on the outer race of the ball bearings and are intended to prevent the emergence of lubricating oil from the ball bearing, now no longer rotate, as a result of the fact that the outer race is stationary. In the known embodiment, on the other hand, in which the inner race is stationary and the outer race rotates, the sealing rings also rotate and thereby become so greatly worn that they drop out of the bearing within a short time.

Another advantage of the band guide roller of the invention is that the forces required for the accelerating of the band guide roller to a given speed of rotation are considerably less, for the same size of ball bearing and band guide roller, than in the case of the known embodiment.

This has a substantial influence in view of the large filling insertion capacity of modern band-gripper looms.

BRIEF DESCRIPTION OF THE DRAWINGS

The invention will be described below with reference to an illustrative embodiment and the figures of the drawing, in which.

DESCRIPTION OF PREFERRED EMBODIMENTS

Figure 1A:
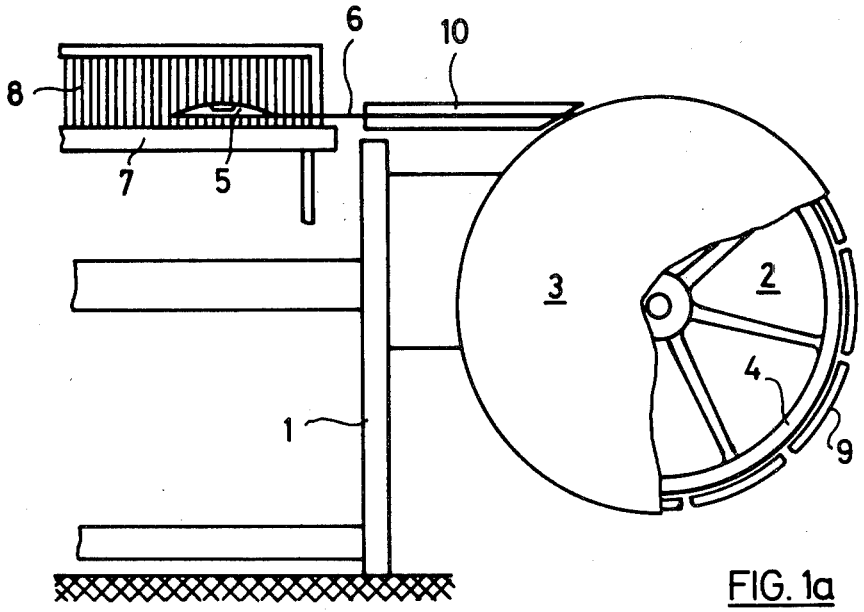
FIG. 1*a* is a diagrammatic front view of the parts of a band-gripper loom which are necessary for an understanding of the invention.

FIG. 1*a* illustrates diagrammatically a portion of a band-gripper loom of known construction having a base plate 2 supported on the machine frame 1 in order to hold a band wheel 4 which is protected by a removable cover 3. The cover 3 is partially cut away in this figure. The filling threads are arranged in the form of a large supply on the side of the loom (not shown) and are offered to a first insertion head 5. The first insertion head 5 is fastened to one end of a flexible insertion band 6 which rests on the wheel rim of the band wheel 2 and is connected to the wheel rim at its other end.

The band wheel 4 is driven in an oscillating manner so that the first insertion head 5 is continuously transported towards the center of the shed (not shown) when the shed is formed and then again pulled out of the shed. At the center of the shed the filling thread is turned over to a second insertion head (not shown), by which the filling thread is introduced from the center of the shed into the second half of the shed, thus completing a thread insertion. After the insertion has been effected, the filling thread is beaten-up by a reed 8 fastened to a batten 7.

As a result of the firm attachment between the band wheel 4 and the insertion band 6, the latter is pushed upon the unwinding and pulled upon the winding. As a result of the pushing upon the unwinding, the insertion band 6 is pressed outwards from the circumference of the band wheel 4 and slides along band guide elements 9 which are arranged fixed in position along a part of the circumference of the band wheel 4. Another band guide 10 is arranged between the band wheel 4 and the shed.

Figure 1B:
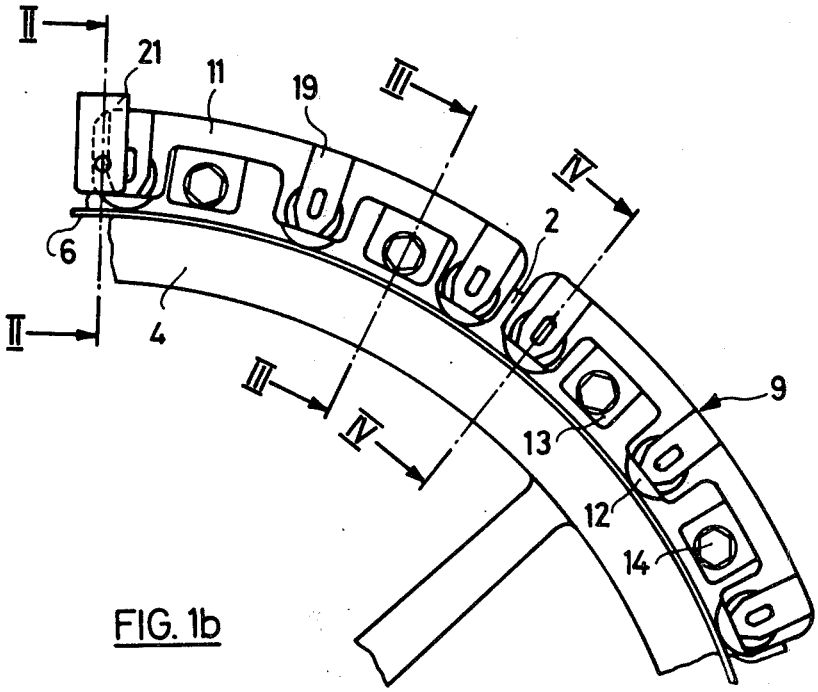
FIG. 1*b* is a partial view of a detail of the band guide rollers shown in FIG. 1*a;*
Figure 5:
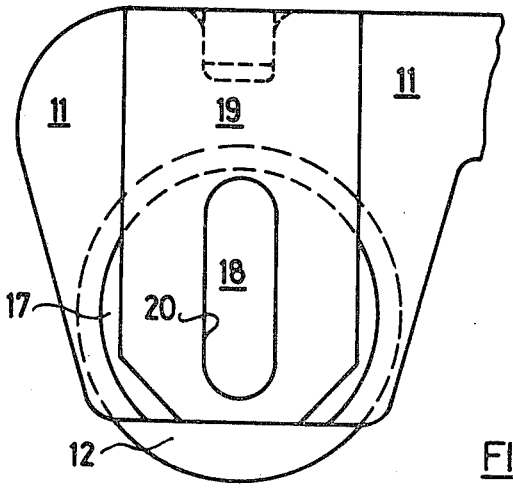
FIG. 5 is a view looking in the direction of the arrow V in FIG. 4.
Figure 6:
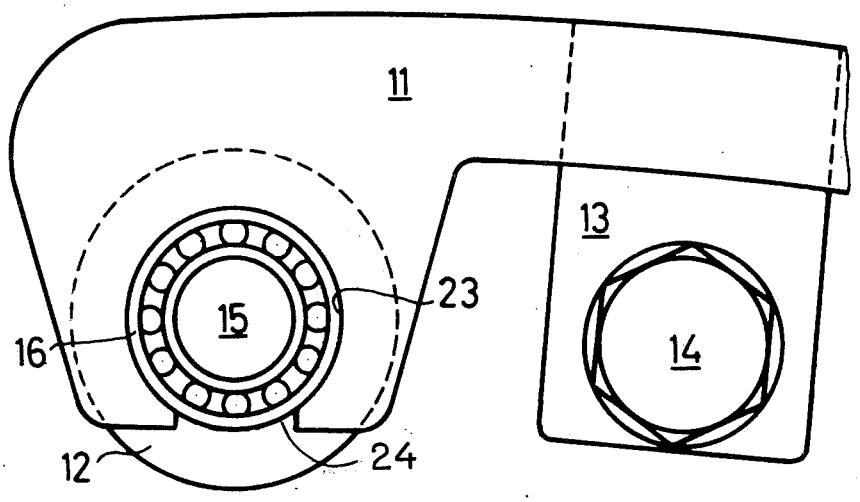
FIG. 6 is a further detailed view looking in the direction of Arrow V of FIG. 4.

The guide elements 9 are shown in greater detail in FIGS. 1*b* and 2 through 5, the cover 3 being omitted in FIGS. 1*b*, 3, 4, 5, and 6 for greater ease in reading the drawings. FIG. 1*b* shows a part of the band wheel 4 in the region of the wheel rim, as well as the associated guide elements 9; FIGS. 2, 3, 4, and 5 each shows a section through a guide element 9; and FIGS. 5 and 6 show portions of FIG. 1*b* on a larger scale.

The guide elements 9 consist essentially of two support rails 11 which are arranged parallel to and spaced from each other, three disks guide rolls 12 per guide element being arranged in said rails. The support rails 11 are spaced from and connected with each other by two spacer plates 13, the said spacer plates being screwed by screws 14 to the base plate 2. The band guide rolls 12 have the shape of a disk with two protruding stub shafts 15, each of which is supported in the inner race of a ball bearing 16 whose outer race is seated in one of the two support rails 11. The ball bearings 16 are each covered on the outside by a plastic disk 17, the disks lying on the side thereof facing the ball bearing 16 against said ball bearing 16 and being provided with a guide projection 18 on the side which faces away from the ball bearing 16. In the region of each band guide roller 12, a spring yoke 19 is placed from above over the guide elements 9, said yoke being provided with a cutout 20 which corresponds to the guide projection 18. The guide projection 18 engages in said cutout 20, as a result of which the disks 17 are held fast.

The band guide rollers 12 consist of a material, the bearing surface of which has a coefficient of friction which is small in the case of slight difference in speed from the speed of the insertion band 6 and relatively large in the case of a large difference in said speed, This has the result that the band guide rollers 12 operate practically free of slippage and there is no heating as a result of slippage. A material having a base of polytetrafluoroethylene which is sold by the du Pont Company under the name "RULON" has these properties.

By the supporting of the band guide rollers 12 on the inner race of the ball bearings 16, a reduction in the speed of rotation of the ball bearing rollers of about 30% is obtained as compared with support on the outer race. Furthermore, for the same size band guide roller 12, the forces of acceleration required are substantially less. These factors contribute essentially to the long life of the ball bearing 16, the supporting of each band guide roller 12 on two ball bearings 16 also having a favorable effect, and resulting in an increase in the life of the ball bearings 16 by about four times as compared with a band guide roller having only one ball bearing.

The guide elements 9 are mounted on the base plate 2 in such a manner that there is a distance of a few tenths of a millimeter, preferably about 0.3 mm, between the insertion band 6 and the bearing surface of the band guide rollers 12. In the case of the first guide element 9, referring to the direction of travel of the insertion band 6, upon the withdrawal of the first insertion head 5 out of the shed (FIG. 1), and therefore the top guide element 9 in FIG. 1*b*, the distance between the bearing surface of the band guide rollers 12 and the insertion band 6 is selected somewhat larger, and preferably amounts to about 0.4 to 0.7 mm.

Figure 2:
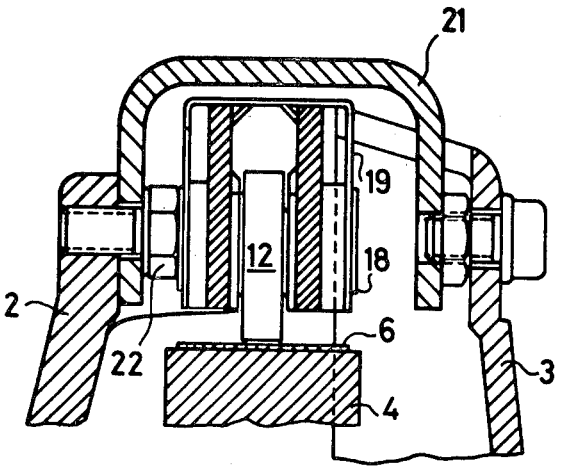
FIG. 2 is a partial cross-sectional view along the line II—II of FIG. 1*b;*
Figure 3:
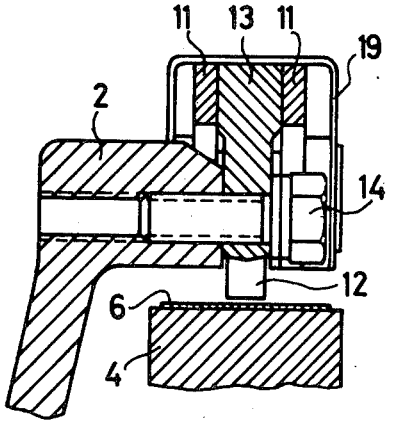
FIG. 3 is a partial cross-sectional view along the line III—III of FIG. 1*b;*
Figure 4:
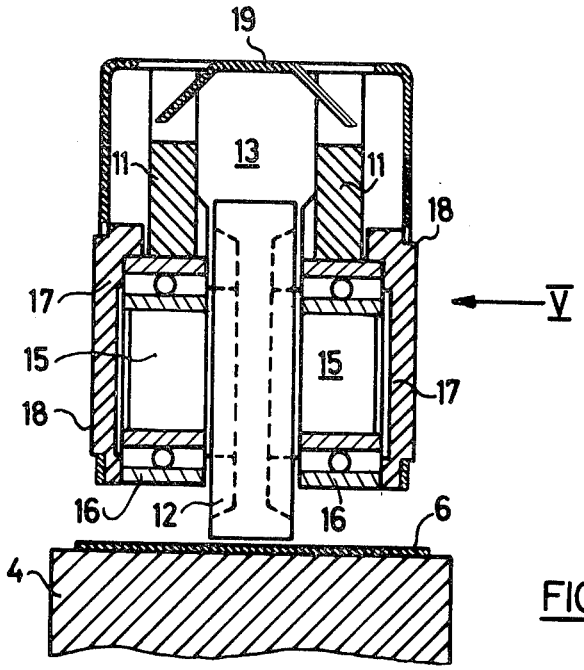
FIG. 4 is a partial cross-sectional view along the line IV—IV of FIG. 1*b;*

A yoke 21 is shown in FIGS. 1*b* and 2. A plurality of such yokes 21, for example three, are provided over the periphery of the band wheel 4, the yokes being screwed by screws 22 to the base plate 2, and thus serve to hold the cover 3, as can be noted from FIG. 2.

FIG. 6 shows essentially the same view as FIG. 5 but for greater ease in reading the drawing, the plastic disk 17 with guide projection 18 and spring yoke 19 are omitted.

Every guide element 9 consists essentially of two parallel support rails 11 which are spaced by the spacer plates 13, the spacer plates and the support rails being welded together in the region of the dotted edges of spacer plate 13 shown in FIG. 6. In the region where a band guide roll 12 is to be mounted, each support rail 11 is provided with a bore 23 for seating the outer race of ball bearing 16. The bores 23 are not closed over their circumference but have an opening 24 extending through the adjacent wall of support rail 11. The width of the opening 24 is larger than the diameter of stub shafts 15.

When producing a guide element 9, in a first step two support rails 11 are welded together with two spacer plates 13. Then the bores 23 are made. In a next step a band guide roll 12 with its stub shafts 15 is moved through openings 24 in the interior space of bores 23. Then in the direction of arrow V in FIG. 4 and in the counter-direction, a ball bearing 16 is pressed between each stub shaft 15 and its corresponding bore 23. After having mounted disks 17 and spring yokes 19, the production of guide element 9 is finished and the guide element can be screwed by screws 14 to the base plate 2.

Although the invention is described in detail for the purpose of illustration, it is to be understood that such detail is solely for that purpose and that variations can be made therein by those skilled in the art without departing from the spirit and scope of the invention except as it may be limited by the claims.

What is claimed is:

1. A band-gripper loom having a band wheel for the driving of an insertion band in an oscillating manner and having band guide rollers supported on a housing surrounding the band wheel, said guide rollers preventing the insertion band from lifting off from the band wheel, said improvement providing band guide rollers having ball bearings mounted on said housing, each ball bearing having an inner and an outer race and each band guide roller operatively supported on the inner race of said ball bearing.

2. The band-gripper loom according to claim 1 in which each band guide roller has the shape of a disk having two stub shafts one protruding on each side, and each stub shaft is supported on the inner race of a ball bearing.

3. The band-gripper loom according to claim 2 in which three guide rollers form a part of each of a plurality of guide elements mounted on a base plate of the housing attached to the loom, each guide element comprising two parallel support rails each for the ball bearings and two spacer plates each which connect the support rails and are fastened to the base plate.

4. The band-gripper loom according to claim 2 in which the guide rollers have, at least on their roller bearing contact surface, a material having a base of polytetrafluoroethylene and their bearing surface produces a small coefficient of friction in case of a small difference in speed from the speed of the insertion band, and a larger coefficient of friction in case of a large difference in speed.

5. The band-gripper loom according to claim 4 in which a plurality of guide rollers forms a part of each of a plurality of guide elements mounted on a base plate of the housing attached to the loom, each guide element comprising two parallel support rails each for the ball bearings and two spacer plates each which connect the support rails and are fastened to the base plate.

6. The band-gripper loom according to claim 4 in which three guide rollers form a part of each of a plurality of guide elements mounted on a base plate of the housing attached to the loom, each guide element comprising two parallel support rails each for the ball bearings and two spacer plates each which connect the support rails and are fastened to the base plate.

7. The band-gripper loom according to claim 2 in which a plurality of guide rollers forms a part of each of a plurality of guide elements mounted on a base plate of the housing attached to the loom, each guide element comprising two parallel support rails each for the ball bearings and two spacer plates each which connect the support rails and are fastened to the base plate.

8. The band-gripper loom according to claim 7 in which the guide elements are mounted on the base plate so that the normal spacing between the bearing surface of the band guide rollers and the roller contacting surface of the insertion band amounts to about a few tenths of a millimeter.

9. The band-gripper loom according to claim 7 in which the guide elements are mounted on the base plate so that the normal spacing between the bearing surface of the band guide rollers and the roller contacting surface of the insertion band is about 0.3 millimeter.

* * * * *